US006398139B1

(12) United States Patent
Nied

(10) Patent No.: US 6,398,139 B1
(45) Date of Patent: Jun. 4, 2002

(54) PROCESS FOR FLUIDIZED-BED JET MILLING, DEVICE FOR CARRYING OUT THIS PROCESS AND UNIT WITH SUCH A DEVICE FOR CARRYING OUT THIS PROCESS

(76) Inventor: Roland Nied, Raiffeisen-Strasse 10, D-84684 Bonstetten (DE)

( * ) Notice: Subject to any disclaimer, the term of this patent is extended or adjusted under 35 U.S.C. 154(b) by 0 days.

(21) Appl. No.: 09/632,985

(22) Filed: Aug. 4, 2000

(30) Foreign Application Priority Data

Aug. 23, 1999 (DE) ..... 199 39 897
Sep. 13, 1999 (DE) ..... 199 43 670

(51) Int. Cl.[7] ..... B02C 19/06
(52) U.S. Cl. ..... 241/5; 241/39; 241/80
(58) Field of Search ..... 241/5, 39, 40, 241/50, 97

(56) References Cited

U.S. PATENT DOCUMENTS 4,848,673 A * 7/1989 Masuda et al. ..... 241/5
5,299,618 A * 4/1994 Fumagalli ..... 241/5

* cited by examiner

*Primary Examiner*—Mark Rosenbaum
(74) *Attorney, Agent, or Firm*—Levine & Mandelbaum

(57) ABSTRACT

A process and device for fluidized-bed jet milling, in which solid particles to be milled, which are suspended in a flowing fluid, are disintegrated into particles of a smaller size by using at least one fluid jet induced to enter the fluidized bed with high energy to bring about an exchange of energy between the particles of the fluidized bed. The interaction between particles and the fluid jet entering the fluidized bed with high energy is influenced, especially in the area of entry of the jet, by a centrifugal force, which acts on the particles in the fluidized bed, in the vicinity of the site of entry of the fluid jet.

14 Claims, 6 Drawing Sheets

PROCESS FOR FLUIDIZED-BED JET MILLING, DEVICE FOR CARRYING OUT THIS PROCESS AND UNIT WITH SUCH A DEVICE FOR CARRYING OUT THIS PROCESS

BACKGROUND OF THE INVENTION

In fluidized-bed jet milling, a flow consisting of a fluid and solid particles suspended in the fluid is generated in a fluidized bed such that the solid particles are reduced in size by the exchange of energy. Part of the flow containing solid particles below a certain mass or a certain weight is diverted in a sifter and fed for further processing, e.g., in a filter, while solid particles above the above-mentioned limit value remain in the residual flow and repeatedly subjected to the fluidized-bed milling until their mass or weight drops below the limit value.

The flow in the fluidized bed is facilitated during fluidized-bed jet milling by fluid jets which are introduced with high energy into the fluidized bed and induce the solid particles in the fluidized bed to engage in increased exchange of energy. This effect is achieved especially well if the high-energy fluid jets are also a suspension consisting of fluid and solid particles, were optionally removed from the fluidized bed, have experienced an increase in energy and are then returned with their increased energy into the fluidized bed.

Several measures have already been proposed to apply this principle in practice especially well.

One of these proposals is based on the discovery that the high-energy gas jets take up solid particles from the fluidized bed on entry into the fluidized bed, so that a disintegration of the particles takes place within the high-energy fluid jets, this disintegration of particles taking place especially effectively when the particle distribution in the high-energy gas jet is influenced such as to bring about the most uniform distribution possible of the particles over the cross section of the jet.

What was deliberately ignored in all these solutions is the circumstance that upon entry into the fluidized bed, not only do the high-energy gas jets bring about an exchange of energy between the solid particles of the fluidized bed and/or of the high-energy fluid jets, but this exchange of energy begins only at a certain distance from the entry of high-energy fluid jets into the fluidized bed, because the high-energy fluid jets first displace at least the solid particles into the fluidized bed as relatively laminar flows before swirling takes place, which leads to the intended exchange of energy.

SUMMARY OF THE INVENTION

The present invention deals precisely with this phenomenon by showing how the high-energy fluid jets can be introduced into the fluidized bed and how the solid particles to be disintegrated can nevertheless be prevented from being displaced at first into the fluidized bed without appreciable exchange of energy; in other words, the solid particles of the fluidized bed shall be kept in the area of the entry of the high-energy fluid jets into the fluidized bed despite the fluid jets introduced into the fluidized bed with high energy, so that the exchange of energy between the solid particles in the fluidized bed takes place reliably and very intensely in the immediate area of the entry of the high-energy fluid jets into the fluidized bed.

The essence of the present invention for accomplishing this object is, on the one hand, that centrifugal forces are caused to act on the solid particles in the area of entry of the high-energy fluid jets into the fluidized bed such that the exchange of energy between the solid particles that become parts of the high-energy fluid jets begins immediately after the penetration of the high-energy jets into the fluidized bed and, on the other hand, that the concentration of the solid particles within the fluid jets is generally improved.

The present invention will be explained in greater detail below on the basis of the drawings, which show, however, only exemplary embodiments, which do not represent any limitation of the essential features of the present invention.

DESCRIPTION OF THE PREFERRED EMBODIMENT

Figure 1:
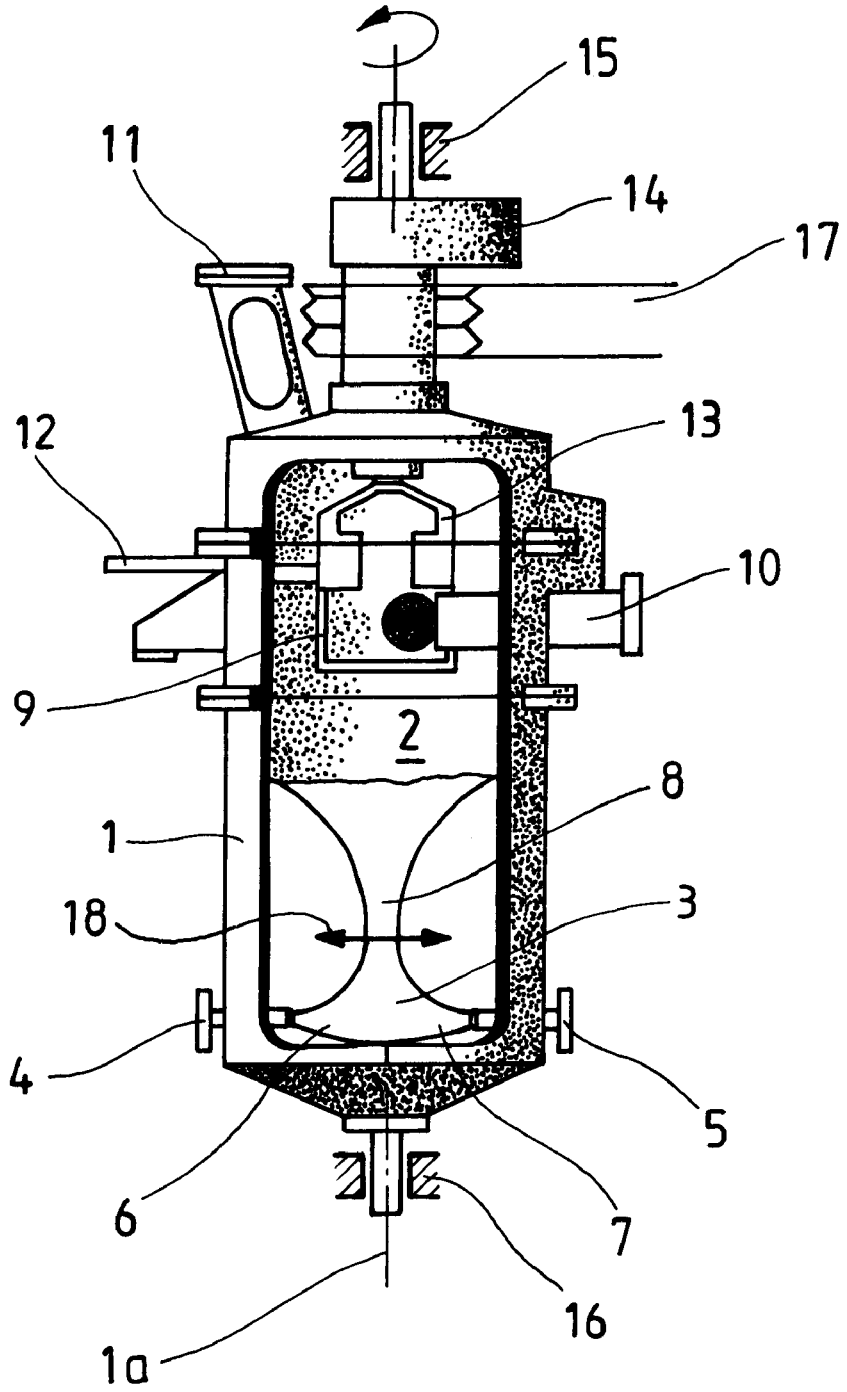
FIG. 1 shows the middle longitudinal section of a fluidized-bed jet mill in embodiment of the present invention.

FIG. 1 shows a fluidized-bed jet mill operated with hot steam. A cylindrical housing 1 encloses a chamber 2, which accommodates the fluidized bed 3 in the lower area and is the milling chamber proper. This fluidized bed 3 consists of solid particles present in a fluid, which are suspended in the fluid more or less uniformly. They have various masses and shall be milled uniformly into very fine particles. High-energy fluid jets 6, 7, which are interspersed with the fluidized bed 3 such that solid particles collide and are disintegrated by the exchange of energy, are blown in for this purpose through two diametrically opposed jet nozzles 4, 5. The particles remain in the fluidized bed and especially in the area of the fluid jets 6, 7 entering the fluidized bed with high energy until their mass has become so small that they are entrained by the upwardly directed jet 8—the sum of the individual jets 6, 7 entering the fluidized bed 3 with high energy, which collide with one another and promote the exchange of energy between solid particles in the process while the solid particles that have not yet been milled to a corresponding fineness remain in the area of the individual jets, i.e., in the fluidized bed 3 proper and are further disintegrated by exchange of energy. A fine material discharge chamber 9, which is in turn joined by the fine material discharge pipe 10 led out of the housing 1, is located in the upper area of the chamber 2 of the housing 1. The fine material leaving the mill through the discharge pipe, which consists of very fine particles that are suspended in part of the fluid, are sent for further processing, e.g., in a filter, in which the particles and the fluid are separated from one another.

The material to be milled enters the mill through a material inlet pipe 11 in the cover of the housing. The steam supply for rinsing the gap between the fine material discharge chamber 9 arranged stationarily in the housing 1 and a sifting wheel 13 arranged rotatably above it is designated by 12. Utilizing the centrifugal force prevailing in it, optionally between the blades in the case of a bladed sifting wheel, the sifting wheel 13 causes only very finely milled material to enter the discharge pipe 10, while material not yet milled so finely is deflected and enters the fluidized bed 3 like the original material to be milled, utilizing the force of gravity, and is further disintegrated there. The drive 14 of the sifting wheel is mounted outside the housing 1 on its cover and is functionally connected to the sifting wheel 13 through the housing cover.

It was observed in such a fluidized-bed jet mill that is known per se that solid particles are entrained in a rather laminar initial flow in the area of the jet nozzles 4, 5, which may be arranged in a plurality of pairs with two diametrically opposed individual nozzles each for introducing jets directed in diametrically opposed directions relative to one another with high energy into the fluidized bed, until the swirling and an effective exchange of energy between the particles take place at a certain distance from the nozzles. This is seen as a disadvantage because the area of the rather laminar flow is lost, so to speak, as a milling area. This shall now be avoided with the present invention and the entrainment of the particles before the nozzle outlets without exchange of energy between them shall be hindered or, in other words, the solid particles shall be kept in the area of the nozzle outlets despite the fluid jets entering the fluidized bed with high energy and the milling process shall begin immediately after the discharge of the high-energy fluid jets, and a certain swirling already immediately in the area of the nozzles would be not only acceptable but even desirable, because the exchange of energy between the particles is at least facilitated, if not outright triggered by it, and the jets have an especially high energy immediately after being discharged from the nozzles.

The desired effect described is brought about according to the present invention by the particles being exposed, on the one hand, to the kinetic energy directed radially inwardly into the milling chamber, as was described, but, on the other hand, they are also exposed to a centrifugal force acting in the opposite direction, centripetal forces (nozzle discharge jets), on the one hand, and centrifugal forces being coordinated with one another such that the degree of the optimal particle disintegration is already present immediately in the area of the nozzles. As can be understood without further explanation, this situation may have, besides a number of functional advantages, the structural advantage that the mill can have a smaller diameter than the stationary mill shown, because the milling area begins closer to the wall, or the diameter may be maintained and the efficient milling takes place in a larger diameter range.

At this state of knowledge, the present invention can be implemented in the fluidized-bed jet mill according to FIG. 1 by causing the mill in its entirety to rotate around its longitudinal axis, while maintaining the rotation of the sifting wheel in relation to the mill housing 1. The mill housing is mounted in suitable bearings 15, 16 at its upper and lower ends and a rotating drive 17 is associated with the mill housing 1, so that the mill is set into rotation by its drive at such a speed or circumferential velocity that a centrifugal force marked by the arrows 18, which counteracts the inwardly directed forces of the jet, is generated in the fluidized bed and the transfugal and transpedal energies are balanced against one another such that an exchange of energy between solid particles of the fluidized bed and optionally of the energy jets 6, 7 also takes place in the areas located immediately in front of the milling jets.

To introduce the raw product through the inlet pipe 11 and the high-energy fluid jets 6, 7 as well as any other high-energy fluid jets that are to enter the fluidized bed 3 into the mill and to remove the finely milled material from the mill through the discharge pipe 10, annular chambers must be arranged in front of the pipes 4, 5 and 11 and an annular chamber must be arranged after the pipe 10, with part of the chamber wall having to be always associated with the mill rotating together with same and another part of the chamber having to be stationary, the two parts of the chamber wall being sealed against one another.

Figure 2:
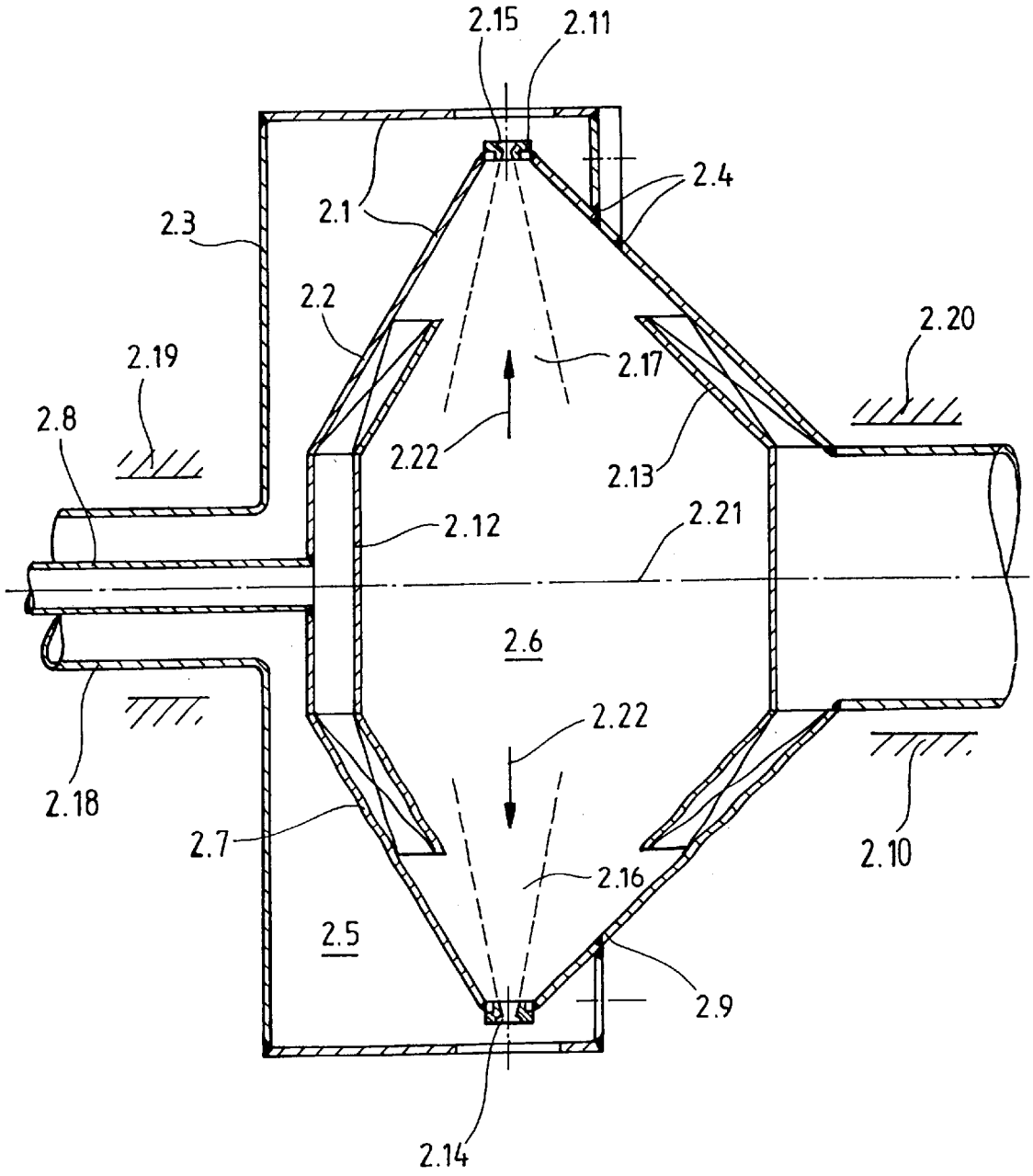
FIG. 2 likewise shows a middle longitudinal section of a fluidized-bed jet mill designed according to the present invention from the very beginning.

While the mill according to FIG. 1 is a prior-art, originally stationary fluidized-bed jet mill, which was converted according to the present invention by causing the housing 1 to rotate around its longitudinal axis 1*a*, the fluidized-bed jet mill according to FIG. 2 is designed according to the present invention from the outset.

The essential part is a rotor 2.1 comprising an inner housing 2.2 and an outer housing 2.3. The inner housing 2.2 and the outer housing 2.3 are connected to one another in such a way that they rotate in unison, which is indicated by welding beads 2.4. They are essentially cylindrical parts associated with one another such that a fluid-tight annular chamber 2.5 is formed between them and the inner housing 2.2 encloses a milling chamber 2.6. An inlet pipe 2.8 for the material to be milled passes through the approximately truncated cone-shaped cover plate 2.7 of the inner housing 2.2, so that the suspension consisting of carrier fluid and solid particles suspended therein enter through the inlet pipe 2.8 for the material to be milled into the milling chamber 2.6, in which the solid particles are subjected to the milling process. A second cover plate 2.9 is located opposite the first cover plate 2.7 and a fine material discharge pipe 2.10 passes through it, so that the suspension consisting of carrier fluid and solid particles suspended therein, which have been milled to the desired, low mass, i.e., the product milled to a desired degree of fineness, can be removed from the milling chamber 2.6 and sent for further processing. The cover plates 2.7 and 2.9 are inclined against one another such that they are connected to the cylindrical circumferential wall 2.11 of the inner housing 2.2 on their greater, equal circumferences and are associated with one another such that the inlet pipe 2.8 for the material to be milled and the fine material discharge pipe 2.10 are associated with one another coaxially. One guide cone 2.12 and 2.13 each are arranged in front of the inlet pipe 2.8 for the material to be milled and the fine material discharge pipe 2.10, the guide cone 2.12 associated with the inlet pipe 2.8 bringing the material to be milled, which enters the grinding chamber 2.6, into the area of the cylindrical circumferential wall 2.11 and supporting this direction of flow, while the guide cone 2.13 associated with the fine material discharge pipe 2.10 expands from the edge of the fine material discharge pipe 2.10 in a funnel-shaped manner such that it defines a well-confined core area of the milling chamber between the inlet pipe 2.8 and the discharge pipe 2.10 together with the guide cone 2.12. At least two jet nozzles 2.14 and 2.15 are held in the cylindrical circumferential wall 2.11 in pairs in mutually opposite directions such that milling jets 2.16 and 2.17 enter through them with high energy into the fluidized bed being formed during the operation of the device, especially in the core area of the milling chamber 2.6. The milling jets 2.16 and 2.17 swirl the suspension in the fluidized bed, solid particles collide with one another and are disintegrated by exchange of energy, as a result of which the fluidized-bed jet milling takes place.

The milling jets 2.16 and 2.17 are formed by fluid that is delivered through the jet nozzles 2.14 and 2.15 after it has been removed from the annular chamber 2.5. The high-energy fluid is fed into the annular chamber 2.5, which is closed except for the jet nozzles 2.14 and 2.15, by a pressurized fluid source from an inlet pipe 2.18 concentrically surrounding the inlet pipe 2.8 for the material to be milled.

The entire system described is mounted rotatably around the axis of symmetry 2.21 in bearings 2.19 and 2.20, so that a centrifugal force directed opposite the directions in which the milling jets 2.16 and 2.17 are blown in is generated during the operation of the unit. The drive of the system is not essential for the present invention and is therefore not shown as it is known. What is essential is such a relation between the energy of the milling jets 2.16 and 2.17, on the one hand, and the centrifugal force 2.22, on the other hand, that the particles to be subjected to size reduction will be maintained as close to the jet nozzles 2.14 and 2.15 as possible in order to reach such a low mass in the milling chamber and in its entirety that the particles will be delivered by the milling jets into the area in which the fine material discharge pipe 2.10 begins and are drawn off by a suitable suction device (not shown as it is a usual and prior-art device) through the fine material discharge pipe 2.10.

Figure 3:
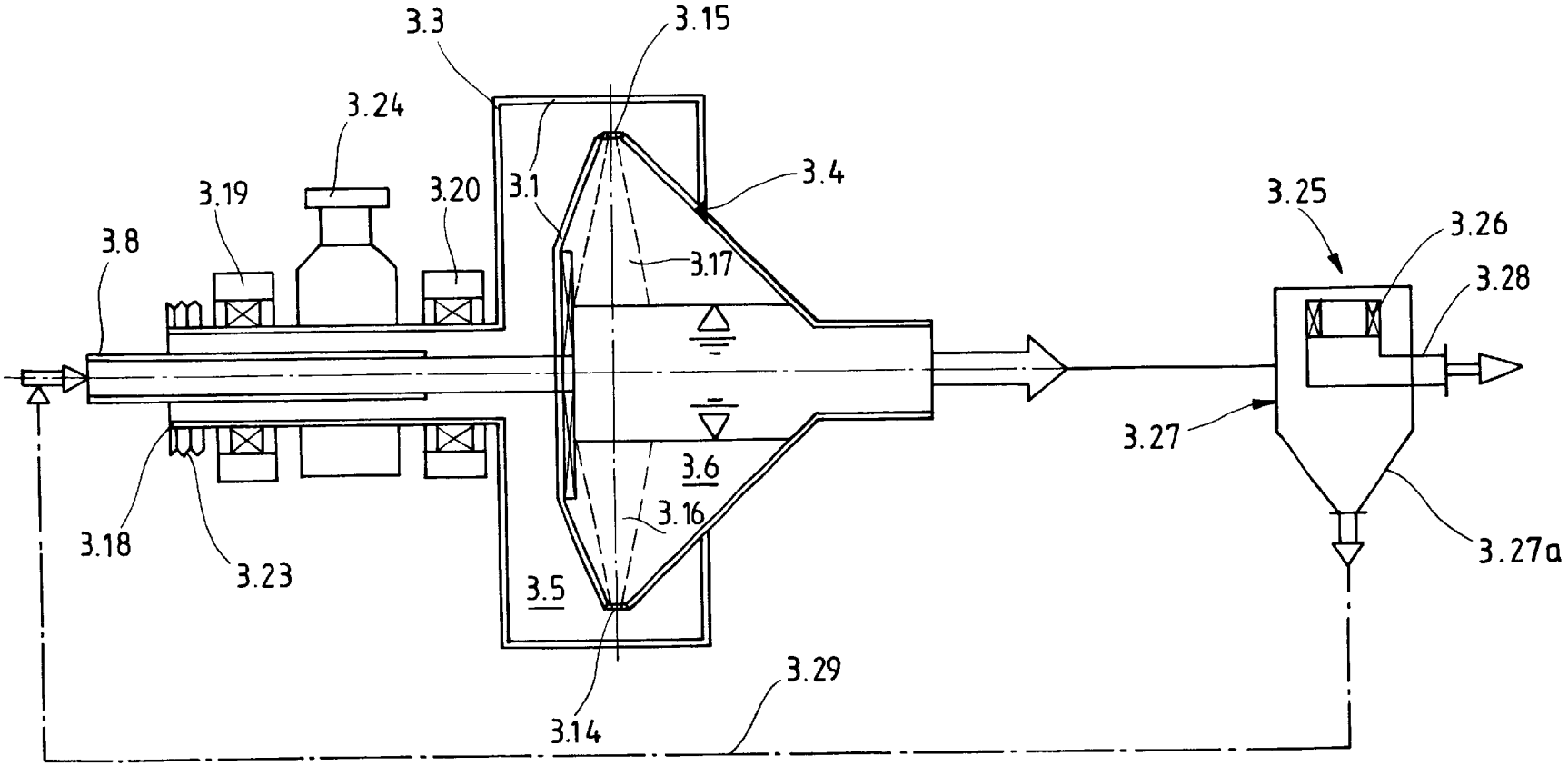
FIGS. 3 through 5 show middle longitudinal sections of other fluidized-bed jet mills designed according to the present invention from the very beginning.

FIG. 3 shows a variant of the device according to FIG. 2, which differs from the embodiment according to FIG. 2 in that instead of being mounted in the bearings 2.19 and 2.20 on both sides of the mill, the mill is cantilevered by the pipes 3.18 (pipes 2.18 in FIG. 2) being mounted rotatably in the two bearings 3.19 and 3.20 which are axially offset in relation to one another.

To the side of the mill and the two bearings 3.19 and 3.20, a drive 3.23 acts on the inlet pipe 3.18. A feed device 3.24, by means of which the pressurized fluid enters into the annular space between the inlet pipe 3.18 and the inlet pipe 3.8 for the material to be milled and from this into the annular chamber 3.5, is arranged between the two bearings 3.19 and 3.20. The mill according to FIG. 3 otherwise corresponds to the mill according to FIG. 2 and the mode of operation is essentially the same in both cases. Identical parts are therefore designated in both FIGS. 2 and 3 by the same numbers after the number of the figures, 2 and 3. Due to the cantilevered mounting with the two bearings 3.19 and 3.20, there is a higher degree of freedom in the utilization of the space on the other side of the mill. The free end of the fine material discharge pipe 3.10 is joined by an air separator 3.25, which has as the essential separating means a bladed sifting wheel 3.26 in a housing 3.27, which said sifting wheel is flown through radially from the outside to the inside. The fine material to be sifted arrives in the housing 3.27 from the mill, so that it enters the radially outer ends of the flow channels between the blades of the sifting wheel 3.26. The relatively fine material reaches the fine material discharge 3.28 arranged in the middle from the inner ends of the blade channels to leave the housing 3.27 through it. The relatively coarser material is deflected at the outer ends of the blade channels and drops down into the funnel-shaped part 3.27*a* of the housing 3.27, from which it is mixed with the coarse material to be fed into the mill via a pipe 3.29 and is subjected to a repeated milling process.

Figure 4:
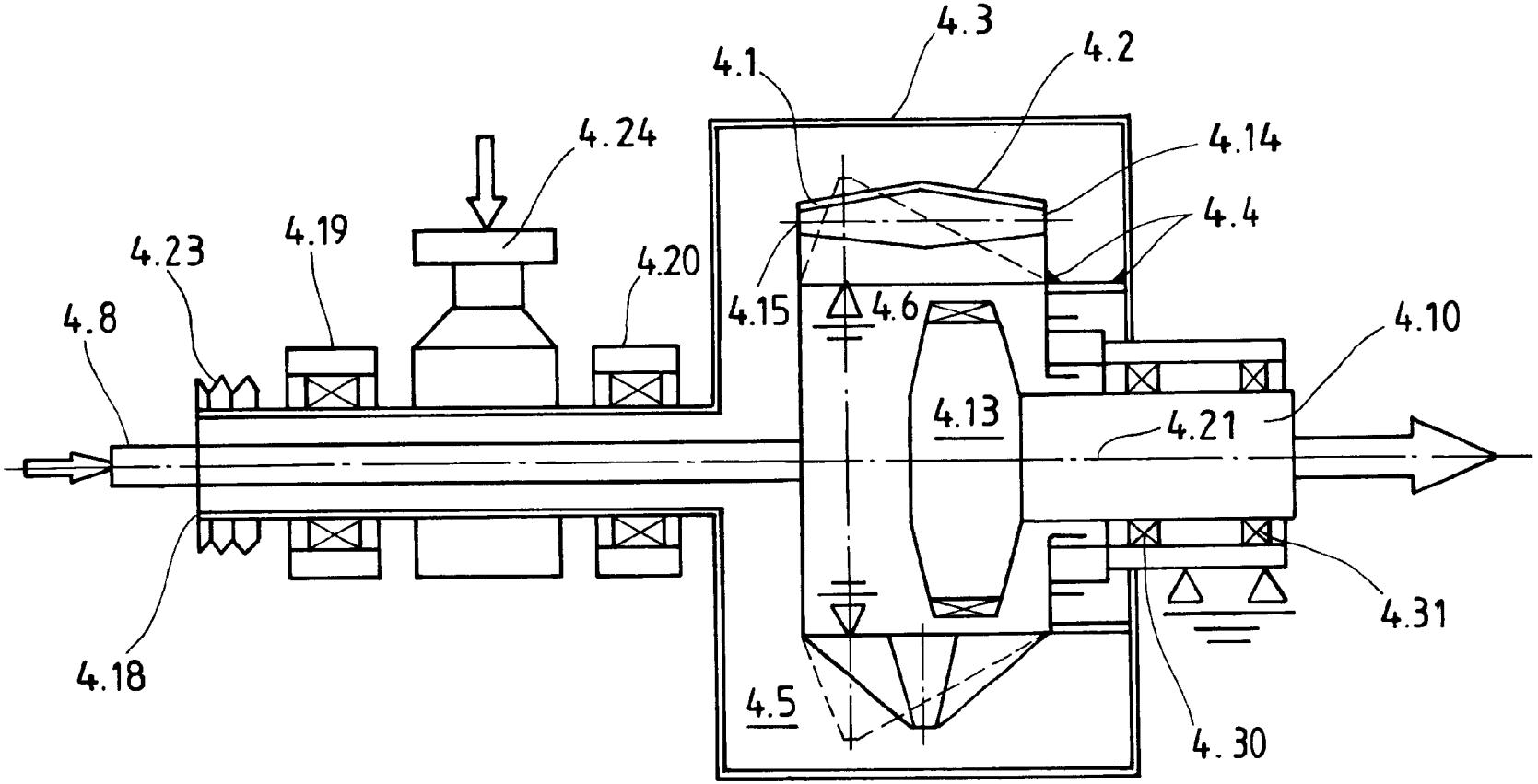

The milling and sifting unit according to the lower part of FIG. 4 is essentially identical to the unit according to FIG. 3, which is expressed by the fact that identical components are designated by the same reference number after the number of the figure and no detailed description will therefore be given, either.

The air separator arranged externally downstream of the mill in FIG. 3 is integrated as an internal device in the mill in the embodiment according to FIG. 4. The bladed sifting wheel 4.13, through which the flow is directed radially from the outside to the inside, is mounted in the milling chamber 4.6, rotating in unison, on the inner end of the fine material discharge pipe 4.10 protruding into the milling chamber 4.6. The milled product reaches the outer ends of the blade channels, and particles below a predetermined mass limit enter through the fine material discharge pipe 4.10 to leave the mill and the sifter, while coarser particles above this mass limit are deflected and subjected to another milling operation. While both solutions of the fine material discharge pipe described so far were rigidly connected to the mill housing and were rotatable with same, the fine material discharge pipe in the solution according to FIG. 4 is rigidly connected to the sifting wheel 4.13 and is mounted rotatably in bearings 4.30 through 4.31 in the assembly unit comprising the inner housing 4.2 and 4.9, so that the sifting wheel can be operated at the speed optimal for sifting relative to the assembly unit comprising the inner housing 4.2 and the outer housing 4.9. The drive acts on the fine material discharge pipe 4.10 and via this, on the sifting wheel 4.13. As far as the milling nozzles are concerned, the embodiment below the center line 4.21 is identical to the embodiments described so far.

In the embodiment above the center line 4.21, the milling nozzles 4.14 and 4.15 are installed in this embodiment such that the high-energy milling jets 4.16 and 4.17 are blown in parallel to the axis of rotation 4.21 of the system, so that the centrifugal forces act laterally on the fluidized bed in the milling chamber and force its solid particles in the area between the milling nozzles into the milling jets.

Figure 5:
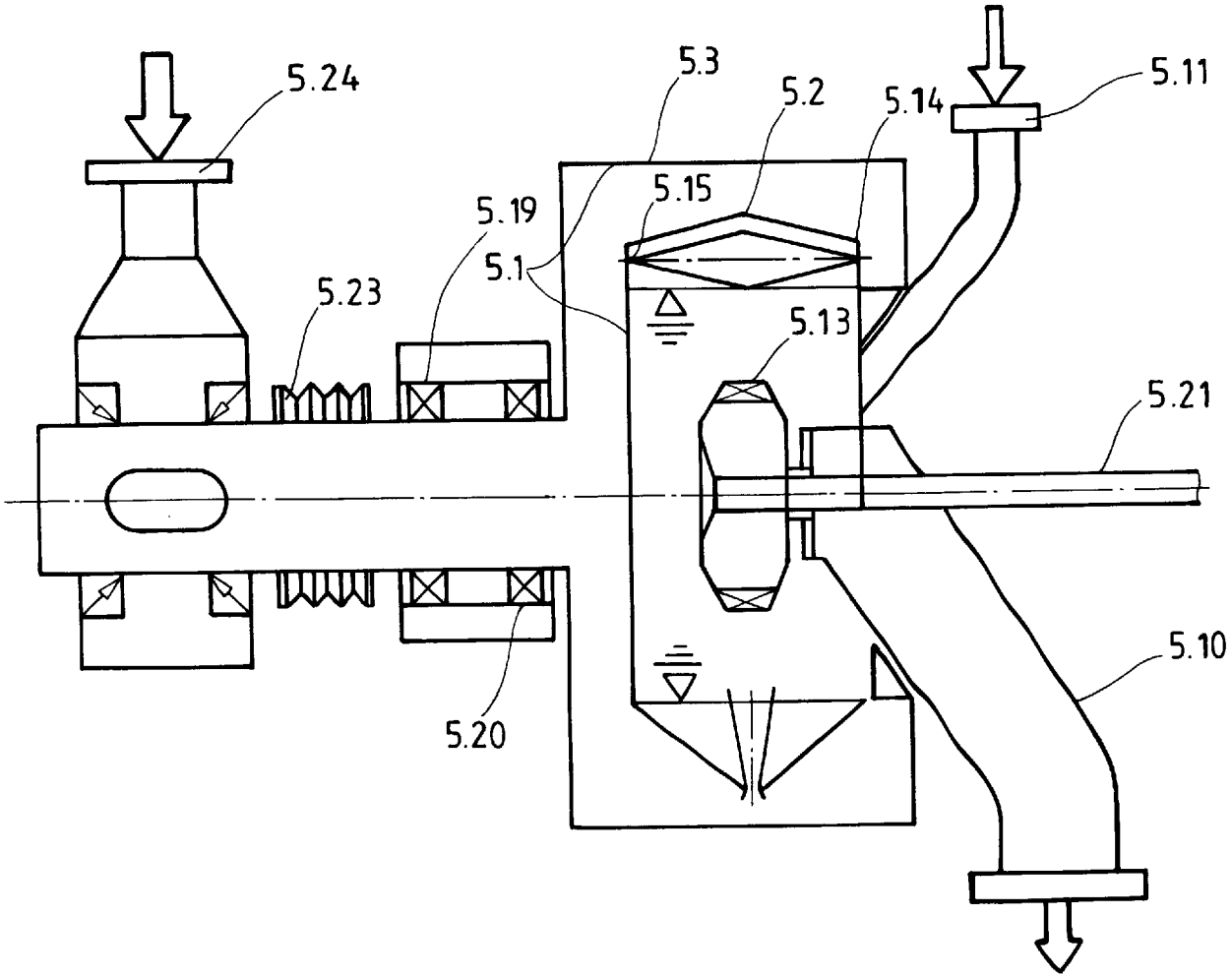

While the material to be milled is fed in the axial direction at an outer end of the inlet pipe 4.12 and the fine material is discharged through the fine material discharge pipe, which is likewise arranged axially and coaxially with the inlet pipe on the other side of the mill housing 4.2, 4.9 in the two embodiments according to FIG. 4, the feed device 5.11 for the material to be milled and the fine material discharge 5.10 are arranged on the same side of the mill housing in the embodiment according to FIG. 5. The unit according to FIG. 5 is otherwise identical to the unit according to FIG. 4, which is expressed by the reference numbers, and the embodiment below the center line 5.21 is in turn identical to the embodiments according to FIGS. 1 through 3, while the embodiment above the center line is identical to the embodiment shown above the center line 4.21 in FIG. 4, i.e., the centrifugal force supports the introduction of solid particles from the fluidized bed into the milling jets.

It is essential in the embodiments according to FIGS. 1 through 3 as well as 4 and 5 above the center line or the axis of rotation that the milling flows enter the fluidized bed directed radially inwardly and an opposing force acts on the solid particles to be milled and sifted as a consequence of the centrifugal force.

Consequently the parts of FIG. 4 and FIG. 5 below the respective axis of rotation 4.21 and 5.21 show embodiments corresponding to the preceding embodiments, in which an accelerating nozzle 4.14 or 5.14, being one of two nozzles that form a pair of nozzles and are directed diametrically opposed to one another, causes a fluid jet 4.6 or 5.6 with high kinetic energy to penetrate into the fluidized bed 4.3 or 5.3 at right angles to the axis of rotation in order to draw in particles from the fluidized bed, which are disintegrated by exchange of energy above all in the fluid jet, wherein a centrifugal force as a consequence of the rotation of the mill around the axis of rotation 4.21 or 5.21 keeps the particles in the immediate area of the nozzle outlet in order to thus act on the particle concentration in the jet. Moreover, the parts of FIG. 4 and FIG. 5 shown above the axis of rotation 4.21 or 5.21 show other embodiments in which the centrifugal force is caused to act on the particle distribution in the jet in another manner. The centrifugal force supports the drawing in of the particles from the fluidized bed into the fluid jet with high kinetic energy over the entire length of the jet by the suction effect and the centrifugal force being directed toward the center line of the jet in the same direction, as a consequence of which more particles will enter the milling jet than would happen under the action of the kinetic energy of the milling jet alone or the vacuum prevailing in the milling jet, as happens in usual jet mills with non-rotating mill housing.

Figure 6A:
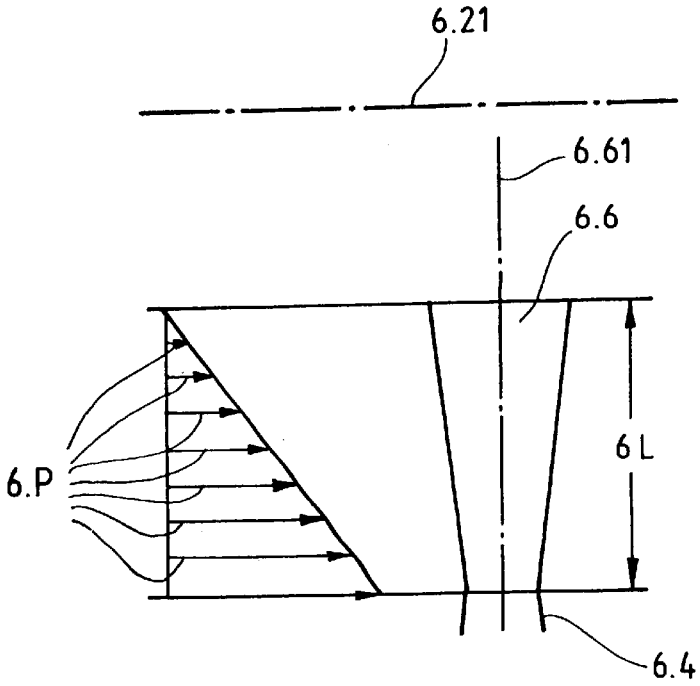
FIGS. 6*a* and 6*b* show diagrams explaining the mode of operation of the present invention in an embodiment as is shown in halves of FIG. 4 and FIG. 5.
Figure 6B:
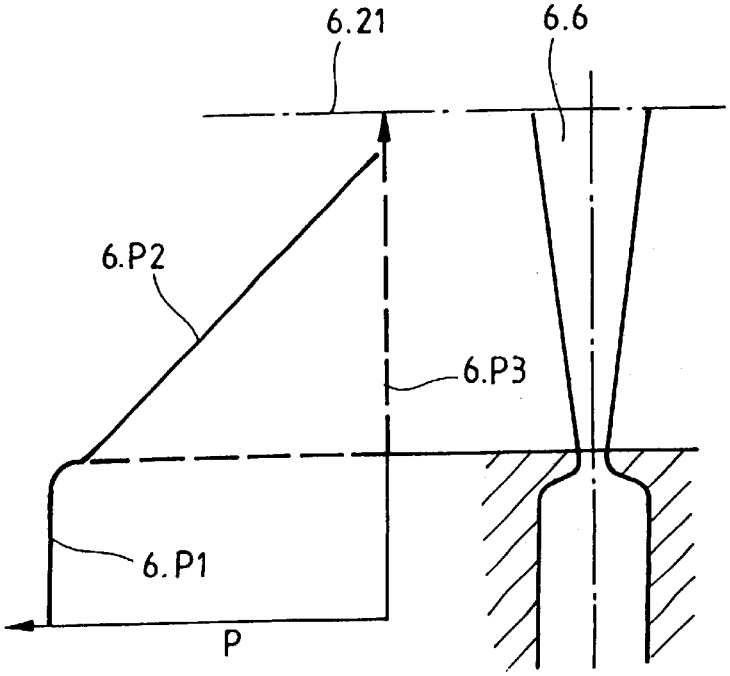

The effect of the rotation of the mill according to the present invention and of the centrifugal force generated as a result can be seen in FIGS. 6A and 6B. FIG. 6A shows how the hydrostatic or quasi-hydrostatic pressure (depending on whether gas or a liquid is used as the fluid), indicated by the arrows 6.P, increases radially from the inside to the outside over the length 6.L of the milling jet 6.6, whose longitudinal axis 6.61 forms a right angle with the axis of rotation 6.21 of the mill in the representation in FIG. 6A and is greatest in the area of the outlet of the nozzle 6.4. Consequently, the hydrostatic pressure, which supports the sucking action for the particles in the milling jet and results from the centrifugal force, is greatest immediately at the nozzle outlet, in an area in which particles drawn in from the fluidized bed are not present in larger numbers according to the state of the art, i.e., the hydrostatic pressure forces particles into the milling jet to a very great extent.

The pressure curve in the milling jet, which is optimal for the milling process and which in turn results from this, is shown in FIG. 6B. The pressure of the material being milled is 6.P1 before the nozzle, the pressure obtained under the effect of the centrifugal force is 6.P2, and the pressure obtained without the effect of the centrifugal force is 6.P3 in the diagram, in which the radius r is plotted as a function of the pressure P.

What is claimed is:

1. A process for milling a particulate material to be milled, which material is suspended in a fluid, comprising causing at least one fluid jet to enter a fluidized bed with high energy and applying centrifugal force to the particles in the area of said at least one fluid jet to influence the particle concentration.

2. A process in accordance with claim 1, wherein the centrifugal force is caused to act essentially at right angles to the direction of said at least one fluid jet in order to support the suction effect of said at least one fluid jet on the solid particles of the fluidized bed in the areas around said at least one fluid jet by the dynamic pressure brought about by the centrifugal force over the entire length of said at least one fluid jet.

3. A process in accordance with claim 1, wherein the centrifugal force is directed essentially opposite the direction of said at least one fluid jet for causing a gradient of the particle concentration along the direction of said at least one fluid jet.

4. Apparatus for milling a particulate material suspended in a fluid, comprising a fluidized bed, an inner housing enclosing said fluidized bed and rotatable about an axis for creating a centrifugal force, at least one fluid jet running in a direction at a right angle to the axis into the fluidized bed in a direction essentially opposite the direction of the centrifugal force, for acting on the fluidized bed in the area of said at least one fluid jet as the fluid enters the fluidized bed with high energy.

5. Apparatus in accordance with claim 4, further comprising an outer housing enclosing said inner housing, wherein excess pressure, which is sufficient for supplying said at least one fluid jet entering the inner housing with high energy, is generated in the area between the inner housing and the outer housing.

6. Apparatus in accordance with claim 5 further comprising a first inlet pipe, the outer housing comprising an inlet-side cover plate mounted concentrically with respect to said first inlet pipe, through which the medium of said at least one fluid jet which enters the inner housing with high energy, enters the area between the inner and outer housings.

7. Apparatus in accordance with claim 6, further comprising a second inlet pipe through which the material to be milled enters the milling chamber enclosed by the inner housing said second inlet pipe being arranged concentrically in the first inlet pipe.

8. Apparatus in accordance with claim 7 further comprising guide means for guiding the material to be milled into the area of said at least one fluid jet which is introduced into the said milling chamber with high energy, said guide means being arranged within the milling chamber at a milling chamber-side outlet opening of the second inlet pipe for the material to be milled.

9. Apparatus in accordance with claim 6 further comprising a discharge-side cover plate mounted on the outer housing opposite the inlet-side cover plate, and a discharge pipe for the milled material, arranged coaxially on the discharge-side cover plate of the outer housing.

10. Apparatus in accordance with claim 9, further comprising guide means disposed between the milling chamber and the inlet opening of the discharge pipe for facilitating entry of the mill material from the milling chamber into the discharge pipe.

11. Apparatus in accordance with claim 5, wherein the inner housing and the outer housing are connected to one another such that they rotate in unison.

12. Apparatus in accordance with claim 4 comprising a sifter with a predetermined separation limit, and means for feeding the milled material to said sifter, wherein the coarser material that is below the limit is returned into the material to be milled, which is to be fed into the fluidized bed, and the fine material above this limit is sent for further processing.

13. Apparatus in accordance with claim 12, wherein the sifter comprises an air separator structurally separated from the mill.

14. Apparatus in accordance with claim 12, wherein the sifter comprises an air separator structurally integrated within the mill.

* * * * *